US005511243A

United States Patent [19]

Hall et al.

[11] Patent Number: 5,511,243

[45] Date of Patent: Apr. 30, 1996

[54] PROTECTIVE SPORTS GLOVE

[75] Inventors: F. Kenneth Hall, Beaconsfield; Bertrand Dessureault; Sylvain Dufour, both of Repentigny; Nicole Ranger, St. Lazare, all of Canada

[73] Assignee: Sport Maska Inc., St. Laurent, Canada

[21] Appl. No.: 386,534

[22] Filed: Feb. 10, 1995

[30] Foreign Application Priority Data

Feb. 2, 1995 [CA] Canada ..... 2141702

[51] Int. Cl.[6] ..... A41D 19/00

[52] U.S. Cl. ..... 2/16; 2/161.1; 2/162

[58] Field of Search ..... 2/16, 20, 161.1, 2/161.4, 162, 169, 159, 910

[56] References Cited

U.S. PATENT DOCUMENTS

| | | | |
|---|---|---|---|
| 3,605,117 | 9/1971 | Latina | 2/16 |
| 4,411,024 | 10/1983 | Hayes | 2/20 |
| 4,497,073 | 2/1985 | Deutsch | 2/16 |
| 4,677,698 | 7/1987 | Angas | 2/16 |
| 4,815,147 | 3/1989 | Gazzano et al. | 2/161 |
| 4,930,162 | 6/1990 | Côté | 2/161 |
| 5237,703 | 8/1993 | Brine et al. | 2/16 |

FOREIGN PATENT DOCUMENTS

| | | |
|---|---|---|
| 1265651 | 2/1990 | Canada . |
| 2035717 | 8/1992 | Canada . |

*Primary Examiner*—Michael A. Neas

*Attorney, Agent, or Firm*—Sterne, Kessler, Goldstein & Fox

[57] ABSTRACT

A sports glove is provided having a padded dorsal surface including padded independent ribs fanning out from the point of the proximate knuckle on the index finger to allow for ergonomic flexing of the glove when the player's hand is gripping a hockey stick. The cuff is provided with a floating padded band loosely attached thereto to cover a flexible waist portion of the cuff, and annular ribs are provided adjacent the waist and the band is made to overlap these ribs in order to provide protection to the wrist in a normal or flexed position.

8 Claims, 5 Drawing Sheets

PROTECTIVE SPORTS GLOVE

BACKGROUND OF THE INVENTION

1. Field of the Invention

The present invention relates to a protective sports glove, and more particularly to an improved glove for the game of hockey, lacrosse, and other similar games involving the use of sticks.

2. Description of the Prior Art

Specialized protective sports gloves for games, such as ice hockey, have existed over the years with little if any change. The glove is generally made of leather with four fingers and a thumb. The inside skin is generally very supple while the dorsal part of the hand is relatively rigid, due to the considerable padding thereon. The inside skin must be somewhat loose in order to allow the player's hand to easily grasp the playing stick. With use, the glove is "broken", allowing the dorsal part to mold itself to the most frequent position of the grip formed by the hand on the stick.

U.S. Pat. No. 4,815,147, Gazzano et al, issued Mar. 28, 1989, describes, as part of the prior art, the lack of ergonomic development in these types of gloves and proposes a realignment of the dorsal padded ribs in order to allow more flexibility of the dorsal portion of the glove and, therefore, a more ergonomic glove.

The cuff area of the conventional glove, including the glove proposed by Gazzano et al, is also meant to protect the wrist, which tends to be very vulnerable to violent impact from sticks or the puck in the game of hockey, or a ball in the case of lacrosse. The wrist, which does not form part of the grip, is exposed from all directions. However, the wrist must remain flexible, yet it must be protected. In Gazzano et al, a padded band is illustrated, which covers the wrist and is separable from the cuff of the glove. The padded band is attached to the cuff of the glove by Velcro and may be adjusted as to length. Portions of the cuff are, therefore, not constrained by the padded band, and thus maximum flexibility of the wrist may be attained.

SUMMARY OF THE INVENTION

It is an aim of the present invention to provide an improved protective sports glove of the type described above.

It is a particular aim of the present invention to provide a protective sports glove with increased flexibility in the grip area while maintaining at least the same degree of protection as similar gloves forming part of the prior art.

It is a still further aim of the present invention to provide a protective sports glove with improved wrist protection.

A construction in accordance with the present invention comprises a protective glove having a grip portion and a cuff and wherein the grip portion includes an interior face conforming to the interior of a human hand with a thumb, an index finger, and three other fingers, and the grip portion including a dorsal, metatarsal area covered with elongated padded ribs crowded close together and arranged such as to provide full padded protection at the dorsal, metatarsal area, the thumb including an independently padded segment from the cuff to the end of the thumb with strategically located flexion zones, a plurality of elongated padded ribs extending along each finger interrupted by flexion zones and extending from the knuckles at the proximate end to the distal end of each finger; a first break line separating the padded finger ribs from the dorsal, metatarsal area of the hand and extending along an axis coincident with the proximate knuckles of the fingers. The dorsal, metatarsal area of the hand is delimited by the first break line and a margin of the cuff in the longitudinal direction, and the thumb and outer edge in the lateral direction, and a plurality of padded ribs fanning out from the proximate knuckle of the index finger to the margin of the cuff and the outer edge and defining secondary break lines between each such padded rib in order to provide flexibility to the glove coincident with the ergonomics of the hand when moving from a stick gripping position at an acute angle to the stick, and padded cuff segments extend beyond the cuff margin.

In another aspect of the present invention, a protective padded glove is provided with a grip portion and a cuff, the grip portion including padded ribs on the dorsal area of the glove and defining a cuff margin extending laterally of the longitudinal axis of the glove, the cuff including a tubular wall partially cut away in an area coincident with the interior of the wrist, the cuff tubular wall including at least a first padded rib adjacent to and extending parallel to a first cuff margin, a second padded rib on the tubular wall spaced apart from and parallel to the first padded rib defining a waist therebetween, at least a third padded rib adjacent and parallel to the second padded rib between the second rib and the edge of the cuff, the first and second ribs being of smaller width and thickness than the third rib and a floating padded band extending about the tubular wall at the waist portion and having a width dimension such as to overlap the first and second ribs, and attachment means loosely attaching the floating padded band to the cuff in the area of the waist, and wherein the free ends of the padded band include fastening means to attach the ends thereof and thus adjust the girth of the padded band, and a padded hinge panel is provided in the cut-out area of the tubular wall to protect the interior of the wrist.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
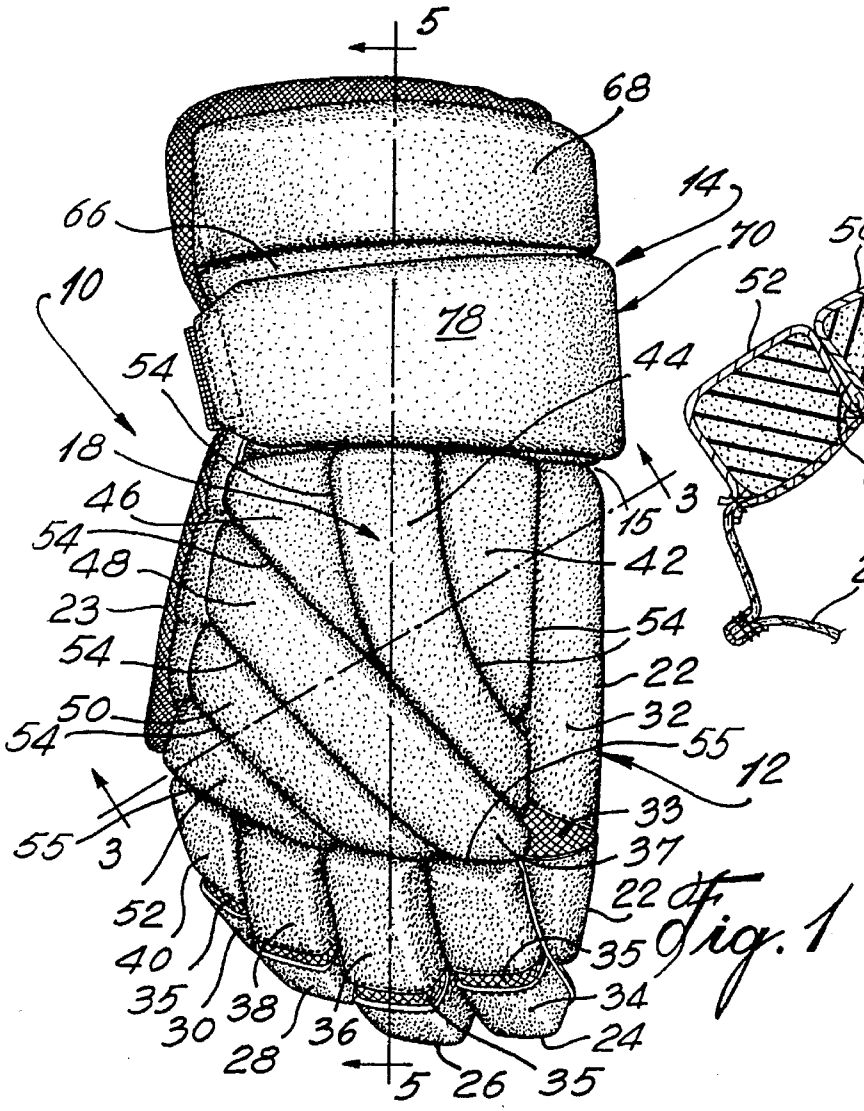
FIG. 1 is a top plan view of a glove in accordance with the present invention, showing the dorsal side thereof.
Figure 2:
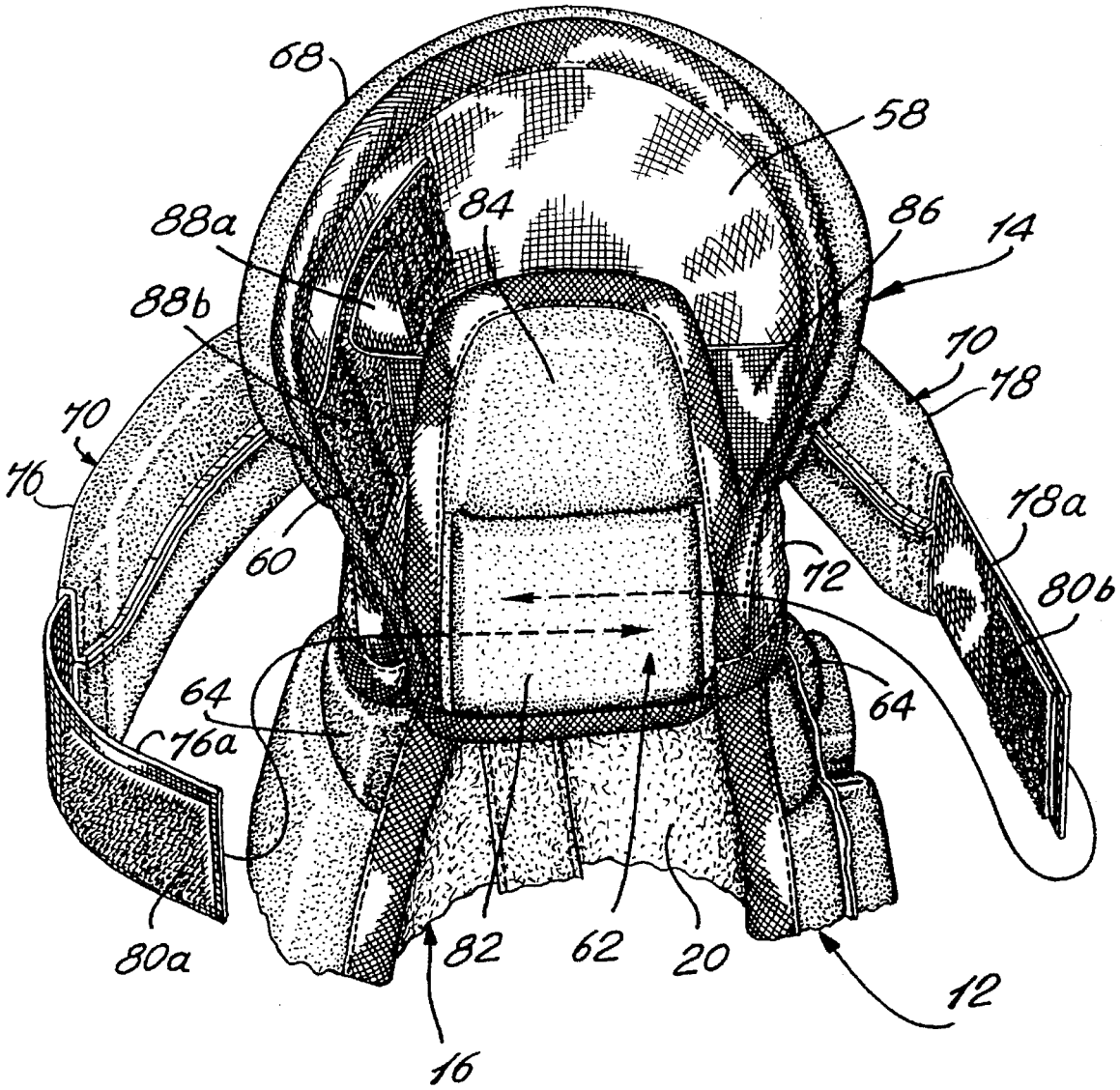
FIG. 2 is a fragmentary perspective view taken from the interior side of the glove shown in FIG. 1.
Figure 5:
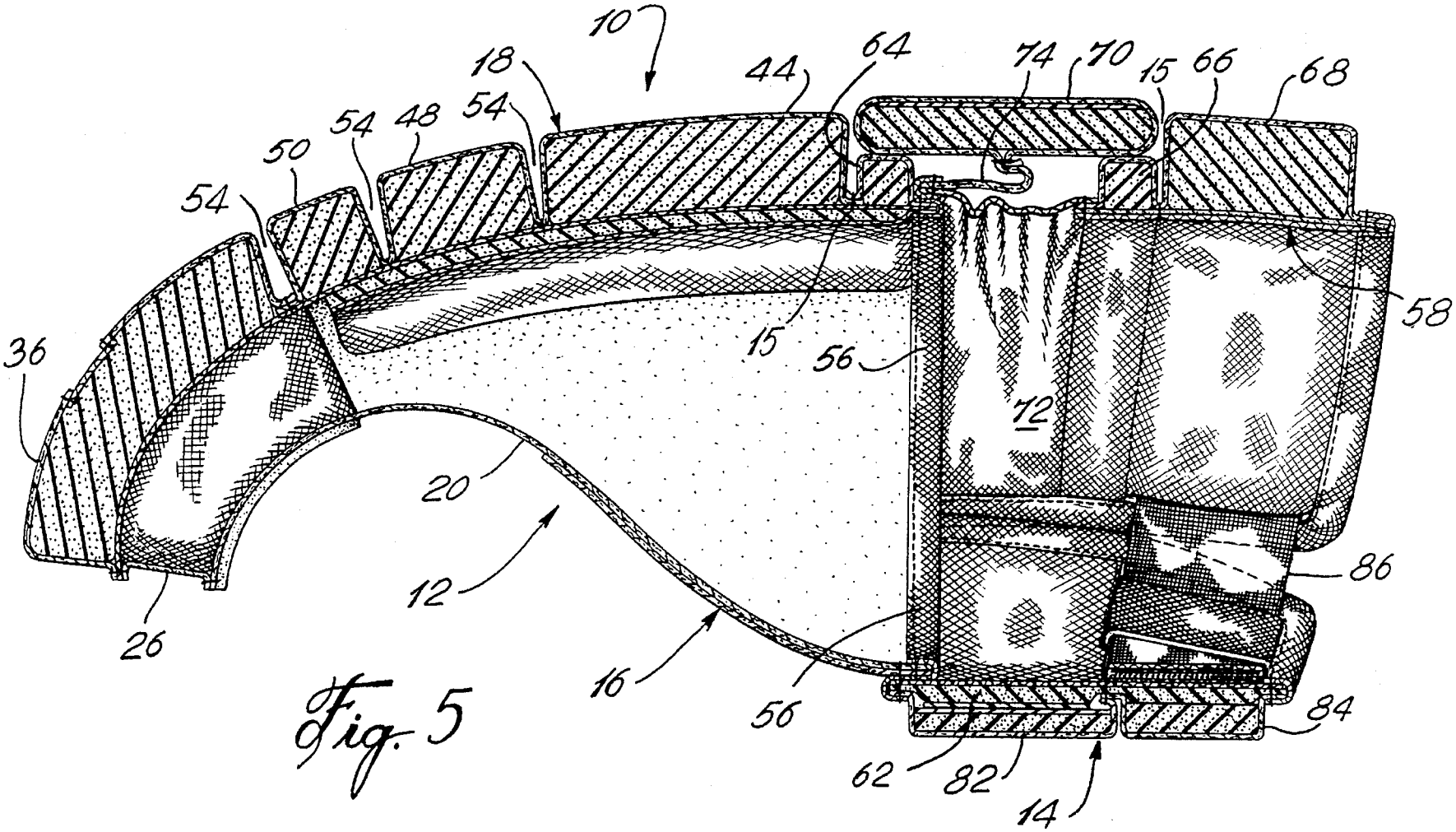
FIG. 5 is a longitudinal cross-section taken along line 5—5 of the glove in a normal position.
Figure 7:
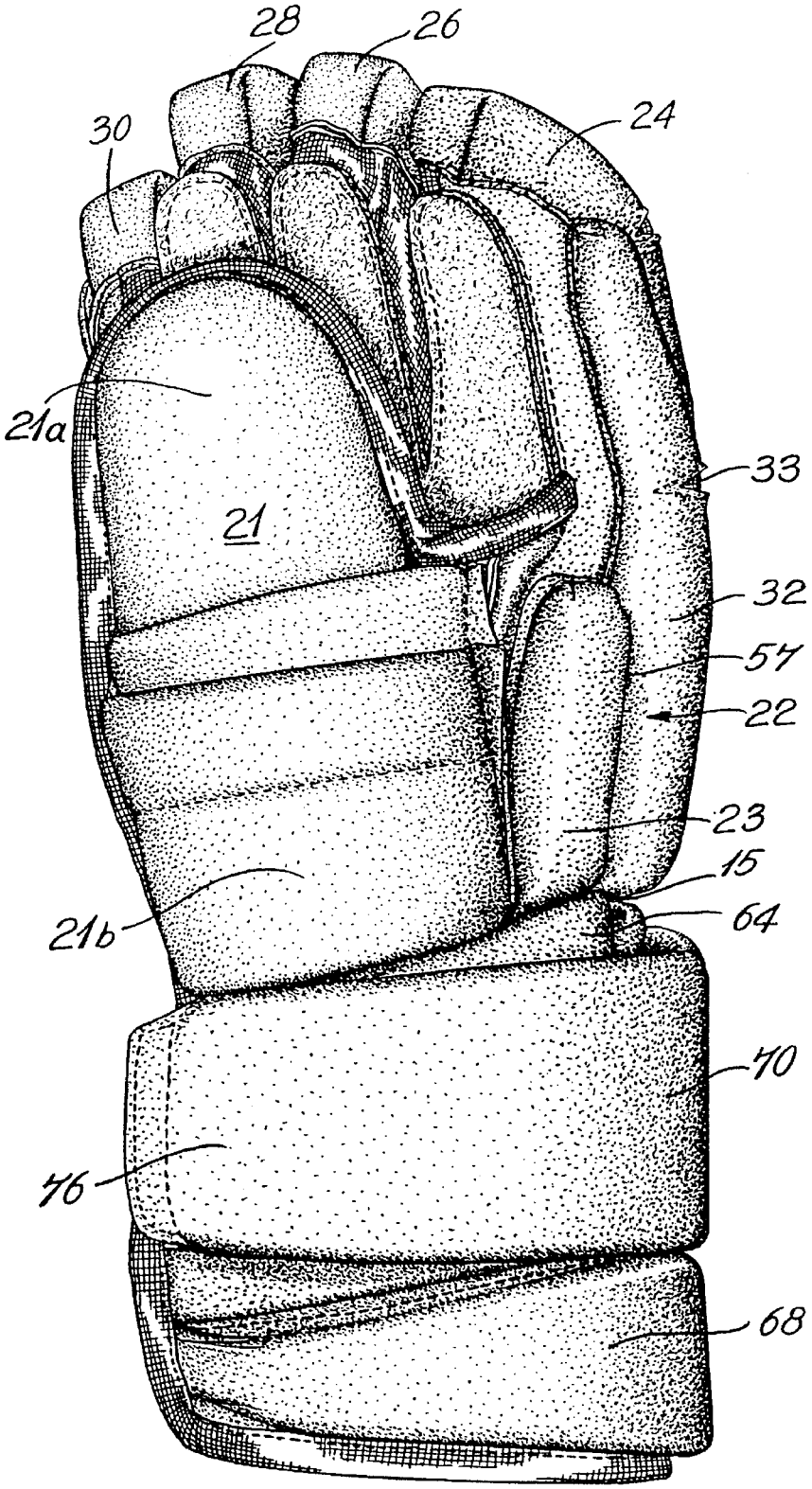
FIG. 7 is a side elevation of the glove shown in FIG. 1.

Referring now to the drawings and in particular FIG. 1, there is shown a hockey glove 10 having a grip portion 12 and a cuff portion 14. The interior side of the glove is identified by the numeral 16, as shown in FIGS. 2 and 5, while the outside of the glove or the dorsal side is identified by the number 18, as shown in FIG. 1, for instance. The grip portion of the glove 10 includes a thumb 21, index finger 24, and fingers 26, 28 and 30. The metatarsal portion of the grip is bounded by the roll 22, the fingers 24 through 30, and the outer edge 23 thereof as well as the cuff margin 15.

The roll 22 is adjacent the index finger 24 and includes an elongated padded portion 32 extending from the cuff margin 15 to a mid-portion of index finger 24. A flexion zone 33 is located on the roll 22. A short thumb roll 23 is located adjacent the roll 22 and the thumb 21. The thumb 21 includes a hard shell 21*a* and a padded overlapped portion 21*b*. The fingers 24 through 30 each have an elongated rectangular padded rib 34, 36, 38 and 40 respectively. Each of these ribs 34 through 40 includes a flexion zone 35.

The dorsal, metatarsal area is completely covered with individual elongated padded ribs. In the present embodiment, as shown in FIG. 1, the elongated ribs appear to fan out from the proximate knuckle of the index finger. Thus, ribs 42, 44, 46, 48, 50 and 52 radiate or fan out from the area of the proximal knuckle zone of the index finger as identified by the numeral 37. Break lines 54 extend between each rib 42, 44, 46, 48, 50 and 52 to permit flexion and cupping in the dorsal, metatarsal area. Break line 55 extends laterally and delimits the dorsal metatarsal area from the fingers 24, 26, 28, 30 and 40.

Figure 3:
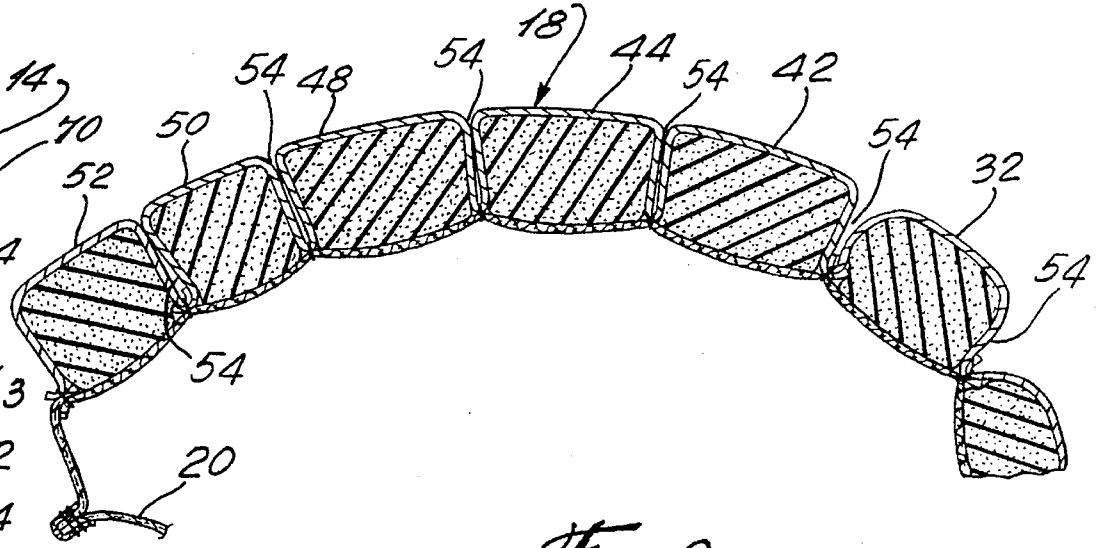
FIG. 3 is a fragmentary cross-sectional view taken along line 3—3 of FIG. 1, showing the glove in a normal position.
Figure 4:
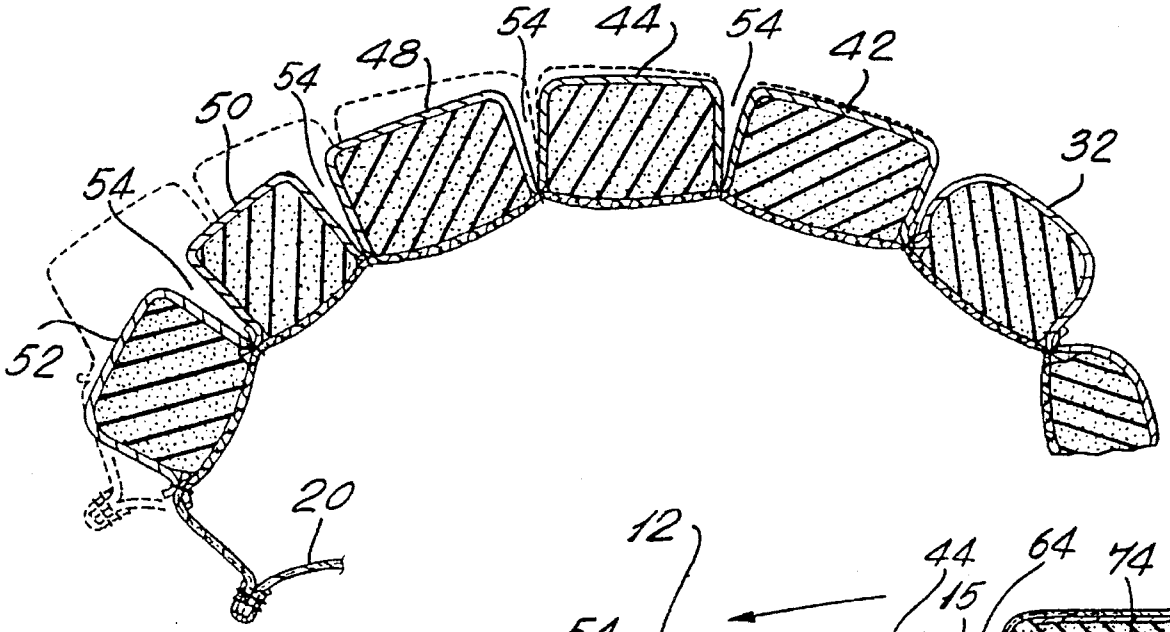
FIG. 4 is a fragmentary cross-sectional view similar to FIG. 3, showing the glove in a flexed position.

Thus, when a player wearing glove 10 grasps the hockey stick, the ergonomical dynamics of the hand is to wrap around the stick using the proximal knuckle of the index finger as a reference point as it would be on the hockey stick. FIGS. 3 and 4 show the manner in which the glove would flex without restraint from an extended position to a flexed grip position on the stick. In more detail, the ribs 42, 44, 46, and the break lines 54 between these ribs, provide the "cupping" flexion of the hand and glove while ribs 42, 44, 48, 50 and 52, and the break lines 54 therebetween, provide for the gripping flexion of the hand on the stick. FIG. 4 is compared to FIG. 3 with the ribs shown in dotted lines. The location of ribs 42, 44, 46, 48, 50 and 52 are thus designed ergonomically to allow the natural flexion of the hand.

The shell or skin 20 on the interior side 16 of the glove is a leather or leather like material which is quite supple and allows the hand to easily grasp the stick while the dorsal side of the glove would normally be more constraining in the light of the thick padded ribs. The present glove overcomes this restraining factor to thereby allow easier manipulation of the stick or other objects by the player.

An improved cuff for a hockey glove is also contemplated wherein an attempt to provide maximum protection from all directions of the wrist of the player is made. The wrist must be free to be articulated in all directions. Thus, the cuff 14 is provided by a waist portion 72 made of a fabric material and is sewn at 56 to the edge of the grip portion 12 adjacent to the cuff margin 15. The cuff 14 is made up as a tubular, relatively rigid wall 58 which has a cut-out 60, as shown in FIG. 2. The cut-out 60, however, is partially protected by a hinged panel 62 as will be described later.

Between the cuff margin 15 and the seam 56, as shown in FIG. 5, there is provided a first small padded rib 64 extending about the periphery of the cuff 14. On the other side of the waist 72 is a similar padded rib 66.

A floating padded band 70 normally covers the waist 72 to protect the player's wrist in this otherwise vulnerable, flexible portion of the cuff 14. The band 70 is loosely attached to the glove by means of web 74 which extends partially along the cuff margin 15. As shown in FIG. 2, the band 70 includes ends 76 and 78 which are tapered and asymmetrical while strips 76*a* and 78*a* are provided with mating hook and loop fasteners 80*a* and 80*b* of the type known under the trade-mark "Velcro". The taper and asymmetry of the band 70 accommodates the natural positioning of the wrist and forearm on a hockey stick and allows a greater range of motion.

Figure 6:
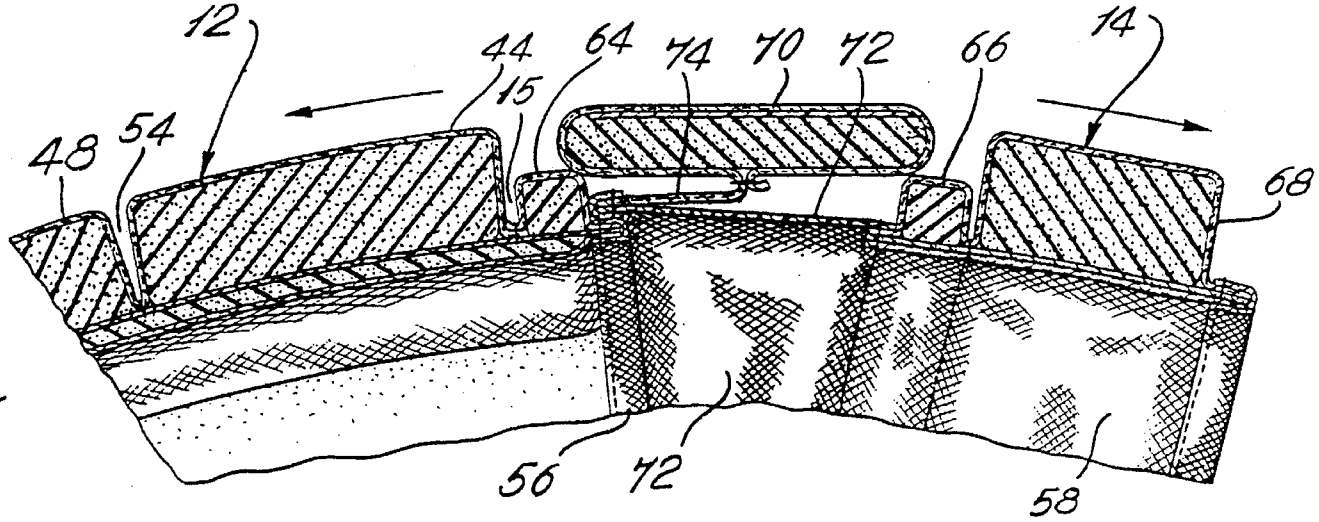
FIG. 6 is a fragmentary longitudinal cross-section similar to FIG. 5, but showing the glove in a flexed position.

The ribs 64 and 66 are dimensioned such that the band 70 overlaps the ribs 64, 66, as shown in FIG. 5, and the combined thickness of the ribs 64 or 66 and the band 70 is not substantially greater than the thickness of the padded rib 68. The purpose of the ribs 64 and 66 is to protect the waist 72 especially when the cuff 14 is flexed to its full extent, as shown in FIG. 6. In prior art gloves, the waist is often exposed when the glove is flexed since the band would only cover a portion thereof since it is meant to fully cover the waist only when the glove is in its normal rest position.

Referring now to FIG. 2, the hinged pad 62 is in two parts and includes a hinged padded sleeve 82 shown in cross-section in FIG. 5. When the glove is being worn, the ends 76 and 78 of the band 70 would be inserted in the sleeve 82 with the fastener retaining the ends of the band 70. Thus, the girth of the band 70 can be adjusted. The hinged pad 62 also includes a hinged sub-panel 84 above the sleeve 82. A band 86 connects the hinged sub-panel 84 to one side of the tubular wall 58 while the other side is provided with a strip having a hook and pile fastener construction cooperating with a complementary strip 88*a*, for instance, on the interior of the wall 58. Thus, the position of the pad can also be adjusted to the preference of the player.

We claim:

1. A protective glove having a grip portion and a cuff, wherein the grip portion includes an interior flexible shell conforming to the interior of a human hand with a thumb and at least an index finger, the grip portion including a dorsal side covered with elongated padded ribs crowded close together and arranged such as to provide full padded protection of the dorsal side, the thumb including an independent padded segment from the cuff to the distal end of the thumb with strategically located flexion zones, at least an elongated padded rib extending along the index finger interrupted by flexion zones and extending from the knuckle at the proximate end to the distal end of each finger; a first break line separating the padded finger rib from the metatarsal area of the hand extending along an axis coincident with the proximate knuckle of the finger, the metatarsal area being delimited by the first break line and the margin of the cuff in the longitudinal direction, and the inner and outer edges in the lateral direction, and a plurality of padded ribs fanning out from the proximate knuckle of the index finger to a margin of the cuff and the outer edge and defining second break lines between each such padded rib in order to provide flexibility to the glove coincident with the ergonomics of the hand when moving from a stick gripping position at an acute angle to the stick and a normal position, and padded cuff segments extend beyond the cuff margin.

2. A glove as defined in claim 1, wherein the ribs fanning out from the proximate knuckle of the index finger include a plurality of ribs extending diagonally from the first break line near the thumb towards the cuff and outer edge.

3. A glove as defined in claim 1, wherein the plurality of padded ribs include at least two ribs extending from near the proximate knuckle of the index finger towards the cuff and at least two ribs extending from near the proximate knuckle of the index finger towards the outer edge.

4. A protective sports glove as defined in claim 3, wherein break lines are formed between the plurality of padded ribs such that the glove can easily flex in a predetermined manner, wherein the dorsal side of the glove hinges along the break lines.

5. A protective sports glove comprising a grip portion and a cuff, the grip portion including padded ribs on the dorsal side of the glove and defining a cuff margin extending laterally of the longitudinal axis of the glove, the cuff including a tubular wall partially cut away in an area coincident with the interior of the wrist, the tubular wall including at least a first padded rib adjacent to and extending parallel to the cuff margin, a second padded rib on the tubular wall spaced apart from and parallel to the first padded rib, a waist defined therebetween, the waist being of flexible material, at least a third padded rib adjacent and parallel to the second padded rib between the second rib and the edge of the cuff, the first and second ribs being of smaller width and thickness than the third rib and a floating padded band extending about the tubular wall at the waist portion and having a width dimension such as to overlap the first and second ribs, attachment means loosely attaching the floating padded band to the cuff in the area of the waist, and wherein the free ends of the padded band include fastening means to attach the ends thereof and thus adjust the girth of the padded band, and a padded hinge panel is provided in the cut-out area of the tubular wall to protect the interior of the wrist.

6. A protective sports glove as defined in claim 2, wherein the combined thickness of the first and second ribs with the overlap band is not substantially greater than the thickness of the third rib and that the band is controlled so as to always at least overlap the first and second ribs when in a normal or flex position.

7. A sports glove as defined in claim 2, wherein the hinge panel within the cut-out portion includes a padded sleeve adapted to receive the ends of the floating band, wherein the ends of the floating band are inserted and adjusted for length to provide a predetermined girth for the band.

8. A protective sports glove as defined in claim 7, wherein a further hinged sub-panel is padded and extends above the padded sleeve portion, and the sub-panel is attached to the tubular wall portion by means of a flexible band on one side and on the other side a band with a hook and loop fastening construction is provided so as to adjust the position of the hinged sub-panel relative to the tubular wall.

* * * * *